US006860595B2

(12) United States Patent
Guerrero Zepeda

(10) Patent No.: US 6,860,595 B2
(45) Date of Patent: Mar. 1, 2005

(54) SYSTEM FOR FINISHING PRINT MEDIA

(75) Inventor: Marco A. Guerrero Zepeda, Guadalajara (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/368,221

(22) Filed: Feb. 18, 2003

(65) Prior Publication Data

US 2004/0160503 A1 Aug. 19, 2004

(51) Int. Cl.[7] ..... B41J 2/01
(52) U.S. Cl. ..... 347/104
(58) Field of Search ..... 347/104, 101; 400/578; 226/10; 399/361

(56) References Cited

U.S. PATENT DOCUMENTS 5,818,186 A 10/1998 Camino

*Primary Examiner*—Raquel Yvette Gordon

(57) ABSTRACT

A system for finishing print media includes a plurality of finishing tools, a housing and a motor. The plurality of finishing tools can be selected based on a desired finishing process. The housing is configured to be shared by the plurality of finishing tools and is configured to mount a selected finishing tool from the plurality of finishing tools. The motor is configured to apply a force to a mounted finishing tool where the force is determined by the desired finishing process.

27 Claims, 5 Drawing Sheets

SYSTEM FOR FINISHING PRINT MEDIA

BACKGROUND

Imaging devices typically pass print media through an imaging process, collect the media in a collating process and may finish the media in a finishing process. The finishing process may include a stapler that can staple the collected paper together. Other types of finishing tools may be included such as a hole punch, a binder, or a scorer. In prior imaging devices, the finishing tools were operated by separate mechanisms so that additional space and cost was associated with having these tools.

The present invention provides a new and useful method and system for finishing print media.

SUMMARY

In accordance with one embodiment, a system for finishing print media is described. The system includes a plurality of finishing tools that can be selected based on a desired finishing process. A housing is configured to be shared by the plurality of finishing tools where the housing is configured to mount a selected finishing tool from the plurality of finishing tools. A motor is configured to apply a force to a mounted finishing tool where the force is determined by the desired finishing process.

In accordance with another embodiment, a method of producing a finishing effect on print media is described. The method includes receiving a finishing request and selecting a finishing tool associated with the finishing request from a plurality of finishing tools. The selected finishing tool is mounted to a common housing and a load can be applied to the mounted finishing tool to cause the mounted finishing tool to engage the print media and form a finishing effect.

BRIEF DESCRIPTION OF THE DRAWINGS

In the accompanying drawings which are incorporated in and constitute a part of the specification, embodiments of a system and method are illustrated, which together with the detailed description given below, serve to describe the example embodiments of the system and method. It will be appreciated that the illustrated boundaries of elements (e.g. boxes or groups of boxes) in the figures represent one example of the boundaries. One of ordinary skill in the art will appreciate that one element may be designed as multiple elements or that multiple elements may be designed as one element. An element shown as an internal component of another element may be implemented as an external component and vise versa.

DETAILED DESCRIPTION OF ILLUSTRATED EMBODIMENTS

Figure 1:
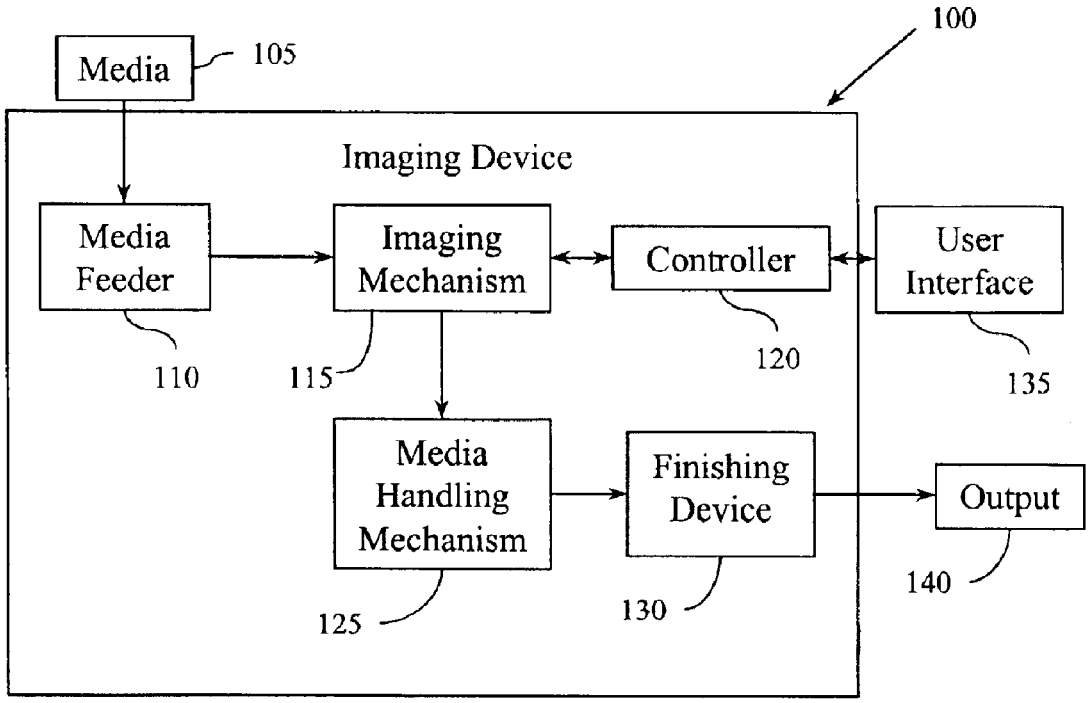
FIG. 1 is a diagram of an example imaging device.

The following includes definitions of selected terms used throughout the disclosure. Both singular and plural forms of all terms fall within each meaning:

"Computer-readable medium" as used herein refers to any medium that participates in directly or indirectly providing signals, instructions and/or data to one or more processors for execution. Such a medium may take many forms, including but not limited to, non-volatile media, volatile media, and transmission media. Non-volatile media may include, for example, optical or magnetic disks. Volatile media may include dynamic memory. Transmission media may include coaxial cables, copper wire, and fiber optic cables. Transmission media can also take the form of acoustic or light waves, such as those generated during radio-wave and infra-red data communications. Common forms of computer-readable media include, for example, a floppy disk, a flexible disk, hard disk, magnetic tape, or any other magnetic medium, a CD-ROM, any other optical medium, punch cards, papertape, any other physical medium with patterns of holes, a RAM, a PROM, an EPROM, a FLASH-EPROM, any other memory chip or cartridge, a carrier wave/pulse, or any other medium from which a computer, processor or other electronic device can read.

"Logic", as used herein, includes but is not limited to hardware, firmware, software and/or combinations of each to perform a function(s) or an action(s), and/or to cause a function or action from another component. For example, based on a desired application or needs, logic may include a software controlled microprocessor, discrete logic such as an application specific integrated circuit (ASIC), a programmed logic device, memory device containing instructions, or the like. Logic may also be fully embodied as software.

"Signal", as used herein, includes but is not limited to one or more electrical signals, analog or digital signals, one or more computer or processor instructions, messages, a bit or bit stream, or other means that can be received, transmitted, and/or detected.

"Software", as used herein, includes but is not limited to one or more computer readable and/or executable instructions that cause a computer or other electronic device to perform functions, actions, and/or behave in a desired manner. The instructions may be embodied in various forms such as routines, algorithms, modules or programs including separate applications or code from dynamically linked libraries. Software may also be implemented in various forms such as a stand-alone program, a function call, a servlet, an applet, instructions stored in a memory, part of an operating system or other type of executable instructions. It will be appreciated by one of ordinary skill in the art that the form of software is dependent on, for example, requirements of a desired application, the environment it runs on, and/or the desires of a designer/programmer or the like.

"User", as used herein, includes but is not limited to one or more persons, software, computers or other devices, or combinations of these.

Briefly describing one embodiment of the present system and method, it provides a mechanism to finish print media with one or more operations. For example, a finishing device according to one embodiment may staple, hole punch, bind, cut, score the print media, or perform combinations of these operations. The finishing device may be included in a imaging device such as a copier, printer, or other device that handles print media. After an imaging request is processed and image data is formed on the print media, the finishing device may apply a desired finishing tool (e.g., a stapler, a hole punch, a scorer, and/or a cutting wheel) to finish the media. Components of the finishing device may include a housing, a plurality of finishing tools, a motor and a drive mechanism. The plurality of finishing tools are interchangeable and are configured to be selectively attached/detached to the housing and the motor. In this manner, components of the finishing device can be shared and leveraged between multiple finishing operations. The motor may be configured to apply different forces or loads to any of the plurality of finishing tools depending on the operation selected.

Illustrated in FIG. 1 is one embodiment of an imaging device 100. For example, the imaging device 100 may be a copier, fax machine, printer, multifunctional peripheral device, all-in-one product, or other device that handles print media. When an imaging request is received, the imaging device 100 inputs print media 105, forms markings onto the print media in accordance with the imaging request, and outputs the media 105. In one embodiment, a feeder 110 pulls the print media 105 from a storage tray and feeds the print media 105 into an imaging mechanism 115 that generates an image onto the print media 105. The term 'image' is used generally herein to represent any markings placed on media such as text, graphics, or other markings. The imaging mechanism 115 is configured to generate or otherwise form an image on the print media using an ink jet mechanism, a laser mechanism, or other type of imaging mechanism available.

The imaging device 100 includes a controller 120 to control and coordinate the mechanisms and devices within the imaging device 100. The controller 120 is embodied as logic and communicates with the mechanisms and devices to process imaging requests. The controller 120 also configures the processes carried out by each mechanism and device. For example, the controller 120 can configure the paper feeder 110 to accept a certain size of print media 105. The controller 120 may provide instructions to the imaging mechanism 115 based on user requests such as to darken the image on the print media 105, to resize the image to fit the size of the print media 105, to produce a certain number of copies of the document, and other instructions. The controller 120 may instruct a paper handling mechanism 125 to sort the print media 105. For example, a collator may be used to sort the media 105. The controller 120 may also instruct a finishing device 130 to finish the print media 105 with a selected operation or effect. A user interface 135 may be provided to allow a user to select desired options for an imaging request. Of course, one or more default settings can be set and imaging settings can be dynamically determined by the imaging device 100 based on optimization algorithms if available.

With further reference to FIG. 1, the user interface 135 may be a part of the imaging device 100 or may be a separate device that communicates with the imaging device 100. For example, the user interface 135 may be a device driver application running on a computer in communication with the imaging device 100. In an alternate embodiment, the imaging device 100 may also have a user interface 135 such as a control panel attached to its housing from which a user may select various options for an imaging request. It will be appreciated that both of these configurations may be in a system.

The imaging device 100 may include a paper handling mechanism 125 configured to organize the media after it has been imaged such as collect, sort, and collate the print media 105. The media can then be outputted to one or more output trays or bins 140 from which the media is removed. Prior to removal, a finishing operation may be performed on the print media such as stapling, punching, binding, cutting, folding, or other type of operation. In that regard, a finishing device 130 is provided.

In one embodiment, the finish device 130 is configured to leverage its components by making them adaptable to a set of finishing tools and finishing operations. For example, a motor can be shared and commonly used for each of the tools so as to reduce the number of components needed. The motor can be configured to apply a force to a finishing tool where the type and/or amount of force changes based on the tool used and the finishing operation being performed. A common drive mechanism can be used to position a finishing tool relative to the print media in accordance with the finishing operation.

In one embodiment, the finishing device 130 is configured to select and mount a finishing tool from an available set of finishing tools based on a requested finishing operation. When a different finishing operation is selected which uses a different tool, a mounted tool is detached and the different tool is mounted. Various types of tools, such as a stapler, may be provided and, other examples of tools are described below.

Figure 2:
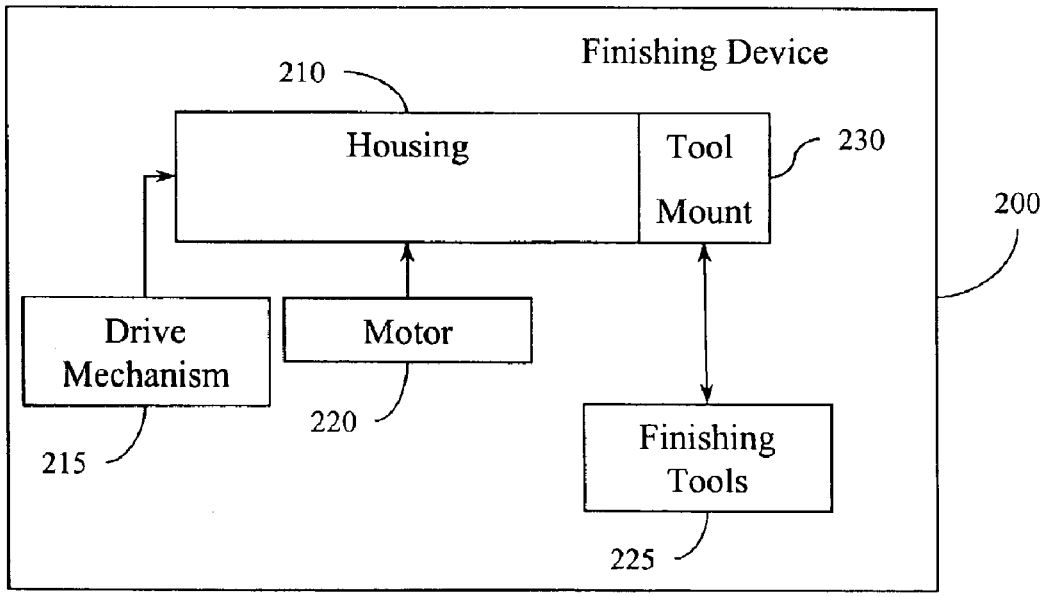
FIG. 2 is a diagram of an example finishing device according to one embodiment of the present invention.

Illustrated in FIG. 2 is a component diagram of another embodiment of an finishing device 200. The finishing device 200, for example, includes a housing 210, a drive mechanism 215, a motor 220 and a set of finishing tools 225. The housing 210 is configured with a tool mount 230 to selectively attach and detach a finishing tool from the set of finishing tools 225 in accordance with a selected finishing operation. The motor 220 is attached to the housing 210 and configured to apply a load upon a mounted finishing tool in accordance with a desired finishing operation. One example of a motor is described in U.S. Pat. No. 5,818,186 entitled "Multiple impact motor drive for stapling," assigned to the present assignee, which is incorporated herein by reference. The drive mechanism 215 is coupled to the housing 210 so that the drive mechanism 215 may position the housing 210, the motor 220, and the mounted finishing tool over the print media 105 to produce a finishing effect. The set of finishing tools 225 are configured to be similarly mounted to the tool mount 230 of the housing 210.

The finishing tools 225 may include any device that finishes media. Such devices include staplers, hole punches, thermoplastic binders, scoring devices and cutting devices. As will be described in greater detail below, some tools include a punch device and a support device such as an anvil. For example, the punch device applies a force from one side of the print media and the support device is positioned on the other side of the print media to provide a solid surface for the punch device and to support the media.

The finishing tools 225 are configured so that they can be mounted to and dismounted from the housing 210. In one embodiment, the finishing tools 225 may be moved individually into contact with the housing 210. In this embodiment, the housing 210 may move into a receiving position near the plurality of finishing tools 225 and attach a desired finishing tool from the plurality of finishing tools 225. In one embodiment, the finishing tools 225 may be stored on a track in a linear relationship. The housing and/or the track may be moved relative to each other such that the housing can contact and attach a finishing. An arm may also be used to retrieve a finishing tool 225 from the track and couple the finishing tool 225 to the tool mount 230.

In another embodiment, the finishing tools 225 may also be stored on a rotatable storage device that pivots around an axis. To mount a selected tool, the storage device may rotate the finishing tools 225 until the selected tool aligns with the tool mount 230 and then is attached. In another similar configuration, finishing tools 225 may be manually mounted by a user. In this manner, a plurality of finishing tools may be used with a common housing, motor, and drive mechanism.

In an alternate embodiment, the housing 210 may be configured to mechanically support the finishing tools 225 and mount them when needed. For example, the housing may be configured to rotatably engage a finishing tool 225 and align it with the motor 220 so that the motor 220 can apply a force to the finishing tool to perform a finishing operation. The housing is further coupled to the drive mechanism 215 so that the drive mechanism 215 may position the housing over the print media 105 and thus position the finishing tool 225 at one or more locations which will receive a finishing effect. In either the individual or rotated embodiment of finishing tools 225, the motor 220 applies a force to the chosen finishing tool 225 to actuate the finishing process on the print media 105. Examples of the finishing tools 225 are described more fully with respect to FIGS. 5A through 9B.

With further reference to FIG. 2, the drive mechanism 215 may be a timing belt controlled by a pulley and gears that move the finishing tool 225 to a desired location over the print media 105. The drive mechanism 215 may also move the finishing tool 225 along a desired path over the print media 105. In another embodiment, the drive mechanism 215 may include a lead screw that controls the position of the housing 210. The drive mechanism 215 may advance the housing 210 along the print media 105 so that a mounted finishing tool overlies a finishing position along the print media 105. The drive mechanism 215 may stop the housing 210 above the finishing position so that the motor 220 may apply a load to the mounted finishing tool and produce a finishing effect. Alternatively, the drive mechanism 215 may move the housing 210 steadily along the print media 105 while the motor 220 applies a continuous load to the finishing tool 225 such as in a cutting operation. Whether the drive mechanism 215 moves the housing 210 steadily along the media or to specific points is determined by the type of finishing operation selected.

In one example, assume a desired finishing operation to form three holes along an edge of the print media 105. A hole punch is selected and mounted to the tool mount 230 of the housing. The drive mechanism 215 would advance the housing 210 along the edge of the print media 105 until the hole punch overlies a first position where a first hole is to be formed in the print media 105. The motor 220 applies a load to the hole punch which punches a hole through the print media 105. The motor 220 releases the load and retracts the hole punch. The drive mechanism 215 then advances the housing 210 along the edge of the print media 105 until the finishing tool 225 overlies the next finishing position, where the process repeats.

As another example, assume that another finishing operation is to perforate the print media. If the hole punch tool, or other tool, is still mounted, it would be detached and returned to a storage position with the other finishing tools 225. In a perforating operation, the corresponding finishing tool is a toothed wheel. The toothed wheel is selected from the set of finishing tools 225 and mounted to the housing 210. The drive mechanism 215 moves the housing 210 and the mounted toothed wheel along a path over the print media 105 and, the motor 220 applies a load to the toothed wheel 225. This causes the toothed wheel to puncture and, thus, perforate the print media 105 along its path of movement.

The motor 220 is configured to provide a variety of forces so as to accommodate a variety of finishing tools and operations. In one embodiment, the motor 220 may provide a constant force to a mounted finishing tool or may provide a repetitive, intermittent force. The motor 220 may also provide a variable and/or intermittent load through multiple pulses as described in U.S. Pat. No. 5,818,186 entitled "Multiple impact motor drive for stapling," assigned to the present assignee, which is incorporated herein by reference.

Figure 3:
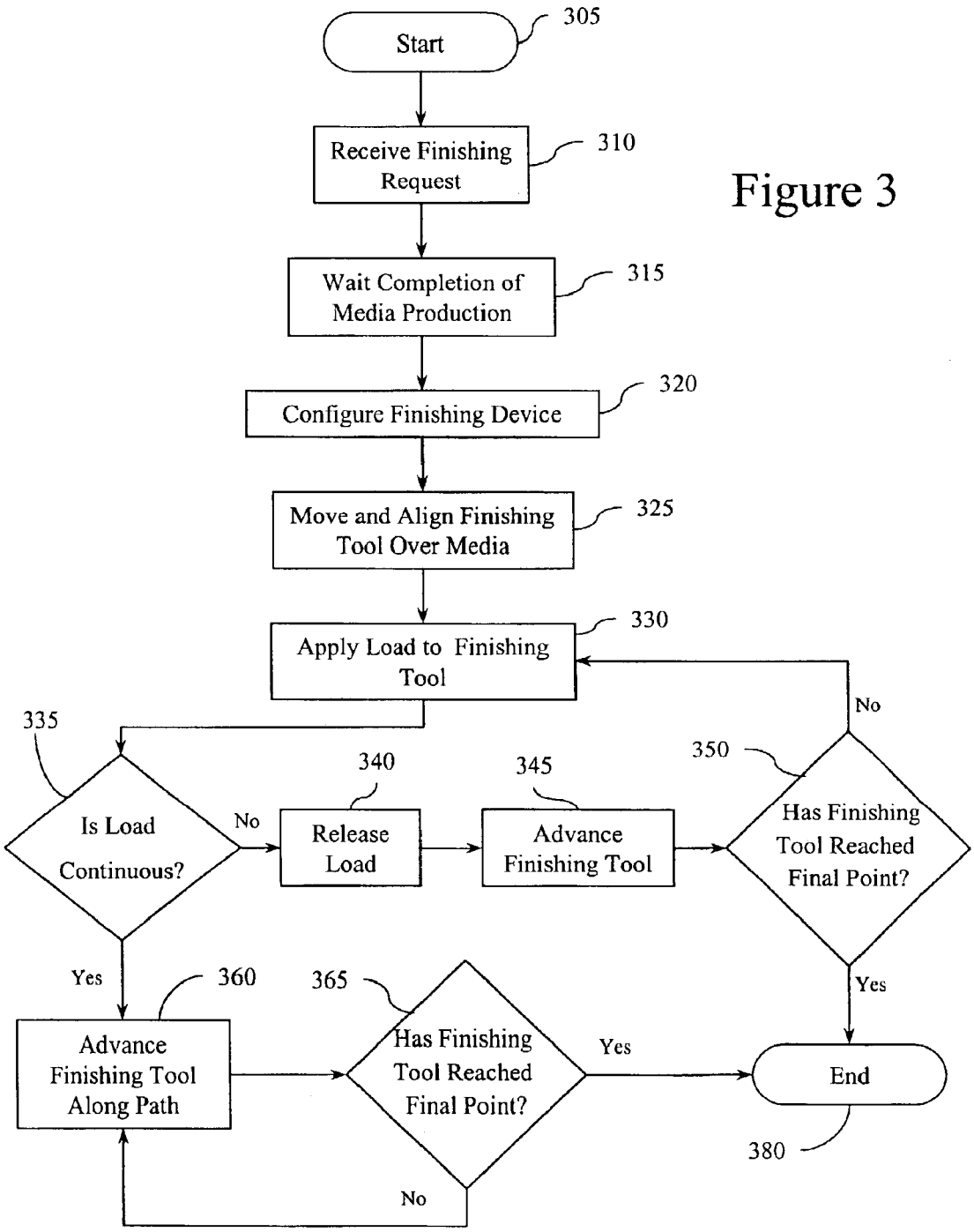
FIG. 3 is one embodiment of a methodology for finishing media.

Illustrated in FIG. 3 is one embodiment of a methodology 300 associated with finishing print media. The illustrated elements denote "processing blocks" and represent instructions or groups of instructions that cause a mechanism or device to perform an action(s) and/or to make decisions. Alternatively, the processing blocks may represent functions and/or actions performed by functionally equivalent circuits such as a digital signal processor circuit, an application specific integrated circuit (ASIC), or other logic device. The diagram, as well as the other illustrated diagrams, does not depict syntax of any particular programming language. Rather, the diagram illustrates functional information one skilled in the art could use to fabricate circuits, generate computer software, or use a combination of hardware and software to perform the illustrated processing. It will be appreciated that electronic and software applications may involve dynamic and flexible processes such that the illustrated blocks can be performed in other sequences different than the one shown and/or blocks may be combined or separated into multiple components.

Illustrated in FIG. 3 is an example methodology for finishing print media. As an imaging device begins to process an imaging request, the imaging request may set various selected options including one or more finishing operations to be performed (Block 305). An available set of finishing operations may be pre-defined which may be selected. For example, presume the imaging device is a copier. The imaging request may include an instruction to finish the print media with a stapling operation. Of course, the finishing operation may be set to one or more default settings, thus, not requiring an instruction from the imaging request.

If a finishing request is received (Block 310), a finishing device can be configured for the finishing request at any time during the imaging process. For example, the process may wait until the print media is imaged (Block 315). Having pre-defined finishing operations, each operation may be defined with associated parameters such as which finishing tool to use, an amount and type of force to apply to the tool, and a location/path on the print media to apply the tool. A finishing device can then be configured based on the finishing operation parameters (Block 320). For example, if the chosen finishing process is stapling and a user wants six evenly spaced staples along the edge of the print media, the finishing request may include this information. The finishing device can then be configured by identifying a stapler tool from an available set of finishing tools and mounting the stapler tool. The motor can be configured to apply an intermittent force as appropriate for stapling and the drive mechanism would be configured to position the finishing tool at six locations along the print media in order to provide the desired request.

Continuing with diagram in FIG. 3, during configuration of the finishing device, a tool is identified for the selected finishing operation and the finishing tool is mounted to the finishing device. As previously described in one embodiment, the finishing tool may be rotated into position from a rotatable storage device and attached to the housing. When the finishing tool is mounted on the housing, the finishing tool is positioned such that mechanical contact with the motor will occur during finishing. In other words, the tool is positioned so that the motor can apply a force to the finishing tool. The finishing device may also be in electrical contact with the motor and the imaging device so that status signals or other information may be communicated with these components as the finishing tool finishes the print media.

Once the finishing tool is mounted and the print media is in position to be finished, the finishing tool is positioned over the print media at a selected finishing location associated with the selected finishing operation (Block 325). This may include moving the finishing tool and stopping it at the selected finishing location. A load is applied to the finishing tool in accordance with the type of finishing operation and tool used (Block 330). The finishing tool finishes the media at the first position. Decision block 335 determines if a continuous load is required. If the load is not continuous, then the load is released (Block 340). The finishing tool is advanced to a next position if necessary (Block 345). If the finishing tool has completed its operation on the print media (Block 350), the process ends (Block 380). If a final position has not been reached, then the finishing operation returns to Block 330 and continues.

If, however, at decision Block 335, a constant and/or continuous load is desired, then the finishing tool is advanced along a prescribed path (Block 360). The path may be defined or selected by the user or it may be defined according to default settings. If the finishing tool has not reached a final position along the media (Block 365), then the finishing tool continues to advance (Block 360). When the finishing tool has reached a final position along the print media, then the method ends (Block 380).

Figure 4:
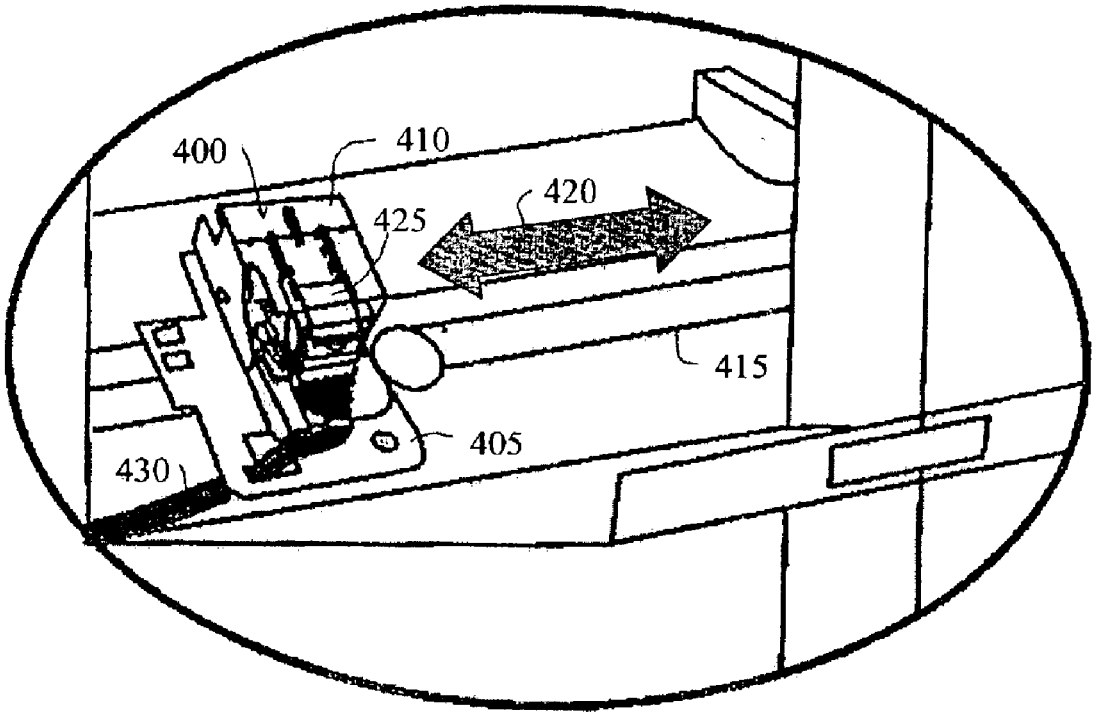
FIG. 4 illustrates one embodiment of a finishing device mounted within an imaging device.

Illustrated in FIG. 4 is an example exploded view of one embodiment of a finishing device 400 mounted within an imaging device. The finishing device 400 includes a housing 405 configured to selectively attach and detach a finishing tool 410. A drive mechanism 415 is attached to the housing 405 and can move the housing 405 along a path represented by arrow 420. The drive mechanism 415 may also be configured to move the finishing device 400 along a path perpendicular to path 420, which would allow two dimensional movements. It will be appreciated that three dimensional movements may also be implemented if desired. As mentioned previously, the drive mechanism 415 positions the housing 405 and a mounted finishing tool 410 over a print media based on a selected finishing operation.

A motor 425 is also attached to the housing 405 and is configured to apply a force to the mounted finishing tool 410 during a finishing operation. The type and amount of force is dependent on the type of finishing operation and, in some cases, dependent on the type or size of media being finished. In that regard, finishing device 400 is configured to change the force applied by the motor 425. For example, the force applied may be single or multiple forces, a continuous force, intermittent forces, variable forces, combinations of these or other type of force used for an operation. In one embodiment, sensors may be included to determine if a finishing operation completed properly. For example, if a stapling operation fails to properly penetrate and staple a stack of papers, an additional force can be applied and/or the amount of force can be increased.

With further reference to FIG. 4, an electrical ribbon 430 is connected to the finishing device 400. The ribbon 430 can provide power to the motor 425 and can provide signal communication between the finishing device 400 and a controller or processor of the imaging device.

Illustrated in FIGS. 5A through 9B are examples of finishing tools that may be used with the various embodiments of the finishing device described above. In one embodiment, the finishing tools are configured with a connector that allows the finishing tool to be mounted to and dismounted from a corresponding connector on the finishing device. The connectors may include male and female type connectors or vise versa. In another embodiment, each tool may be contained in a housing that is configured to be mounted to the finishing device, for example, by snap connecting the housing to a mounting portion of the finishing device.

Generally speaking, each tool includes a punch and an anvil. The punch will refer to a component that applies a force to the print media and, the anvil will refer to a component that supports the print media and receives the punch. The tools are configured such that the punch and anvil can be positioned on opposite sides of the print media. In one embodiment, each finishing tool 500, 600, 700, 800, or 900 includes a housing configured to receive print media through an open side. A closed side of the housing couples the anvil to the punch. An example housing 525 is shown in FIG. 5A.

Generally, the finishing tool 500, 600, 700, 800, or 900 is configured to travel relatively close to an edge along the length of the print media. The housing, though, may be configured to orient the finishing tool to travel along the width of the paper. The housing may rotate the finishing tool 500, 600, 700, 800, or 900 so that the closed side of the finishing tool is oriented parallel to the direction in which the tool is to move. By rotating the finishing tool, the housing may orient the finishing tool 500, 600, 700, 800, or 900 to travel over the length and width of the print media.

Figures 5A, 5B:
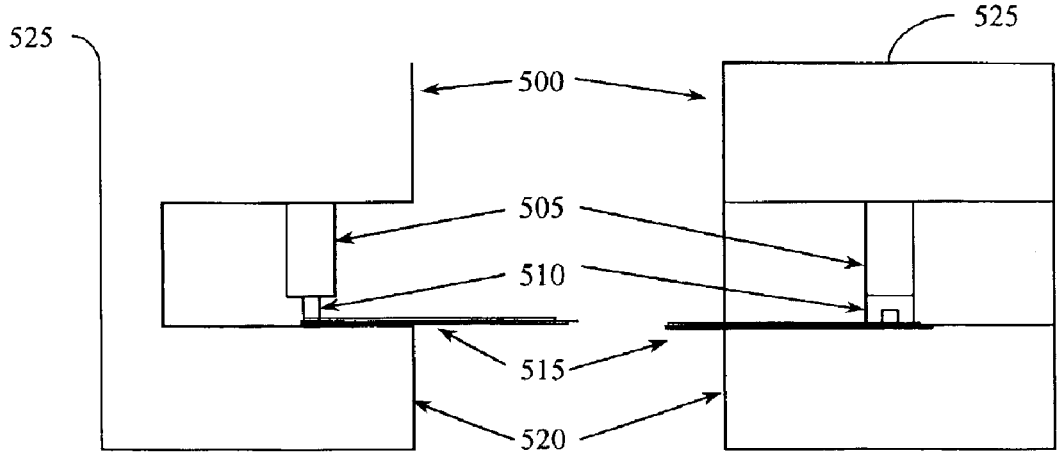
FIGS. 5A and 5B are side and front views of one embodiment of a finishing tool that may be included in the finishing device of the present system.

With reference to FIGS. 5A (side view) and 5B (front view), one embodiment of a stapling finishing tool 500 is shown. The tool 500 includes a punch 505 configured to apply a load to a metal wire 510 (the staple) that drives the staple 510 through print media 515. An anvil 520, positioned on the opposite side of the print media 515, is shaped to bend the staple 510 around the back of the print media 515. Alternate embodiments of the finishing tool 500 may rotate the staple 510 so that the staple 510 may be oriented in different positions with respect to the print media 515. A housing 525 supports the punch 505 and the anvil 520.

Figures 6A, 6B:
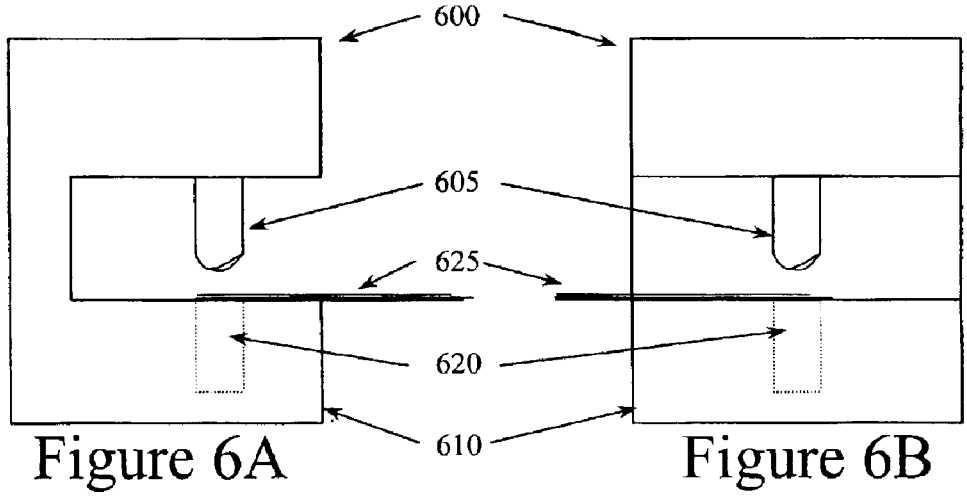
FIGS. 6A and 6B are side and front views of one embodiment of another finishing tool that may be included in the finishing device of the present system.

In FIGS. 6A (side view) and 6B (front view), one embodiment of a punching finishing tool 600 is illustrated. A punch 605 is sharpened and grooved such that it can cut and puncture a print media to create a hole. An anvil 610 has a receiving hole 620 to direct the punch 605 as it punches through the print media 625.

Figures 7A, 7B:
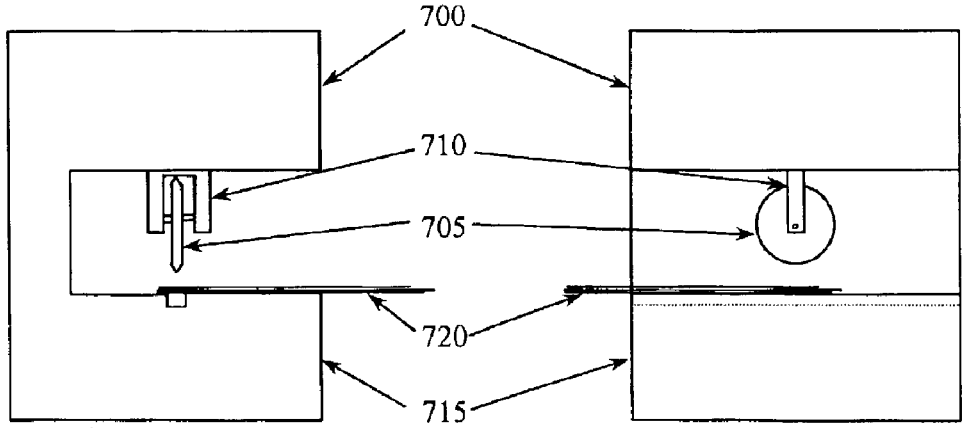
FIGS. 7A and 7B are side and front views of one embodiment of another finishing tool that may be included in the finishing device of the present system.

In FIGS. 7A and 7B, one embodiment of a scoring finishing tool 700 is illustrated. A wheel 705 is attached to a punch 710. As the punch 710 is lowered to an anvil 715, the wheel 705 is free to rotate along the print media 720 to score the print media 720. The scored media 720, for example, letters that are to be folded, may be scored along the length of the print media 720. If the wheel 705 is sharpened, then the wheel 705 may be used to cut the print media 720. In an alternate embodiment, the wheel 705 may have teeth that can perforate the print media 720. Such perforations may be used to provide a line for tearing the media by hand.

In these embodiments of the scoring tool 700, the punch 710 may rotate so that the wheel 705 can be aligned to travel in other directions. For example, with a two dimensional driving mechanism, the scoring tool 700 may first be oriented to travel along the width of the print media 720. The punch 710 may be rotated to orient the wheel 705 at an acute angle to the orientation of the scoring tool 700. By moving the drive mechanism in two dimensions and orienting the wheel 705 at an acute angle, the scoring tool 700 may score the print media 720 across a diagonal of the print media 720.

Figures 8A, 8B:
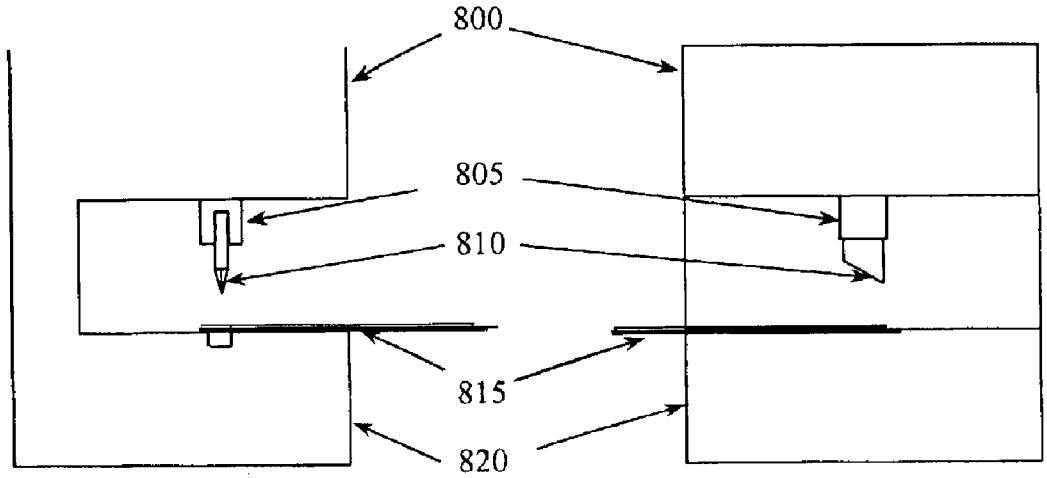
FIGS. 8A and 8B are side and front views of one embodiment of another finishing tool that may be included in the finishing device of the present system.

In FIGS. 8A and 8B, one embodiment of a cutting tool 800 is illustrated. The tool 800 includes a punch 805 connected to a knife 810 or other sharpened object that is capable of cutting print media 815. An anvil 820 is configured to direct the edge of the knife 810 as the knife 810 passes through the print media 815. For thin print media 815, the knife 810 may be lowered through the print media 815 and pulled through the print media 815. If the print media 815 is thick, then the knife 810 may be lowered and lifted repeatedly as the cutting tool 800 is pulled through the print media 815. In this manner, the knife saws through the print media 815. It will be appreciated other methods of controlling a motor to drive a tool can be used such as methods similar to those described in U.S. Pat. No. 5,818,186 entitled "Multiple impact motor drive for stapling."

Figures 9A, 9B:
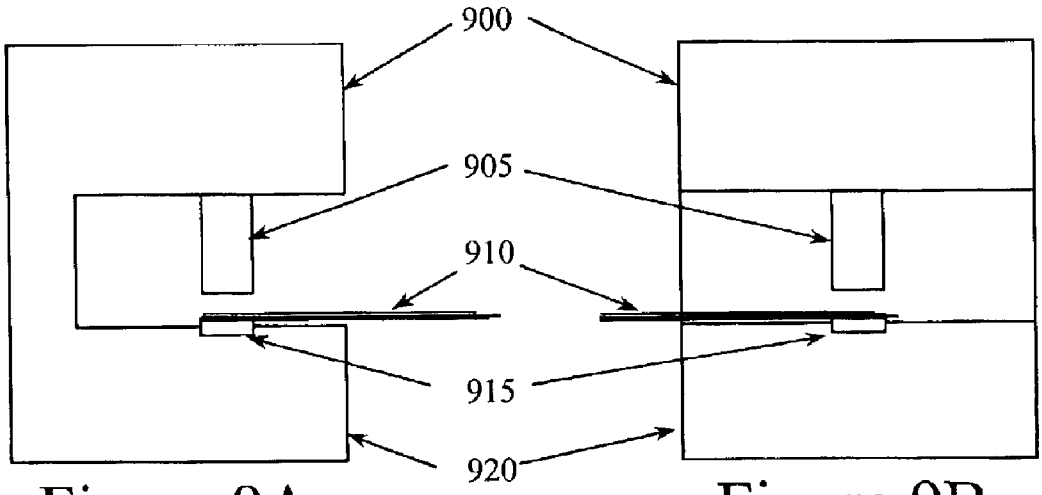
FIGS. 9A and 9B are side and front views of one embodiment of another finishing tool that may be included in the finishing device of the present system.

In FIGS. 9A and 9B, one embodiment of a binding finishing tool 900 is shown. The tool 900 includes a punch 905 that can be heated, for example, by the joule effect. The heated punch 905 can then apply pressure to print media 910 causing a thermoplastic 915 to melt against the print media 910. The melted thermoplastic 915 binds separate pieces of the print media 910 together. The thermoplastic 915 may be initially attached to the media 910 or may be pressed to the print media 910 by an anvil 920. As the binding tool 900 is moved along the print media 910, the print media 910 is bound together.

During the finishing processes performed by the example tools in FIGS. 5A through 9B, the tools may provide constant loads, intermittent loads, and/or variable loads to the print media. For example, the stapling process, the punching process, the cutting process and the binding process may provide intermittent loads along the media. If the finishing process directs the drive mechanism to finish the print media every inch, then the load would be applied by the motor to the finishing tool every time the drive mechanism moves the finishing tool an inch along the print media. On the other hand, the scoring process, the perforating process, the cutting process and the binding process may require a constant load to be applied to the media. The motor may apply a load to the finishing tool as the drive mechanism moves the motor and finishing tool along the media.

While each finishing process may be performed by itself, multiple finishing processes may be performed in series to create additional finishing processes. For example, a user may desire to bind print media together while allowing the ability to remove some of the pages from the bound print media. This finishing process may be accomplished by first binding the print media with the binding tool, removing the binding tool, attaching a perforating tool, and then perforating the print media.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

I claim:

1. A system for finishing print media, the system comprising:

a plurality of finishing tools that can be selected based on a desired finishing process, where the plurality of finishing tools are not staples;

a housing configured to be shared by the plurality of finishing tools where the housing is configured to mount a selected finishing tool from the plurality of finishing tools; and a motor configured to apply a force to a mounted finishing tool where the force is determined by the desired finishing process.

2. The system of claim 1 further including a storage device for storing the plurality of finishing tools.

3. The system of claim 2 wherein the storage device is rotatable.

4. The system of claim 2 wherein the storage device maintains the plurality of finishing tools in a linear relationship.

5. The system of claim 1 further including a drive mechanism configured to position the housing at one or more selected locations.

6. The system of claim 1 wherein each of the plurality of finishing tools includes a connector for attaching to and detaching from the housing.

7. The system of claim 1 wherein each of the plurality of finishing tools includes a tool housing configured to selectively attach to and detach from the housing.

8. The system of claim 1 wherein the motor is configured to apply a constant load to the mounted finishing tool as the drive mechanism moves the housing along the print media.

9. The system of claim 1 wherein the motor is configured to apply a force on a mounted finishing tool at predetermined points along an edge of the print media.

10. The system of claim 1 wherein plurality of finishing tools include a punch and an anvil.

11. The system of claim 1 further including a collator configured to sort the plurality of pieces of print media.

12. A method of producing a finishing effect on print media, comprising the steps of:

receiving a finishing request;

selecting a finishing tool associated with the finishing request from a plurality of finishing tools that are not staples;

mounting the selected finishing tool to a common housing; and applying a load to the mounted finishing tool to cause the mounted finishing tool to engage the print media and form a finishing effect.

13. The method of claim 12 further comprising moving the finishing tool along the print media.

14. The method of claim 13 wherein the step of moving the finishing tool is comprised of:

moving the finishing tool to a finishing position;

stopping the finishing tool at the finishing position; and moving the finishing tool to another finishing position.

15. The method of claim 14 wherein the stopping step further includes the step of applying a load to the finishing tool.

16. The method of claim 12 further including the step of orienting the print media perpendicular to an axis extending through the finishing tool.

17. The method of claim 12 further including storing the plurality of finishing tools such that a finishing tool may be selected therefrom.

18. An imaging device comprising:

an imaging mechanism configured to form an image on a print media; and a finishing device configured to finish the print media, the finishing device being configured to mount a selected finishing tool from a plurality of finishing tools on a common housing where the selected finishing tool is not a staple.

19. The imaging device of claim 18 further comprising a user interface configured to receive a finishing request from a user.

20. The imaging device of claim 18 further includes a storage device for storing the plurality of finishing tools.

21. The imaging device of claim 20 wherein the storage device is configured to rotate the plurality of finishing tools.

22. The imaging device of claim 20 wherein the storage device is configured maintain the plurality of finishing tools in a linear relationship.

23. The imaging device of claim 18 wherein the finishing device includes a motor configured to apply a force to a mounted finishing tool during a finishing operation.

24. The imaging device of claim 23 wherein the motor is configured to apply a varying force.

25. The imaging device of claim 18 where the plurality of finishing tools include two or more of: a stapler, a hole punch, a scorer, and a cutting wheel.

26. The imaging device of claim 18 where the plurality of finishing tools are interchangeable and are configured to be selectively attached to and detached from the common housing.

27. The imaging device of claim 18 where each of the plurality of finishing tools are configured with a connector that allows a finishing tool to be mounted to and dismounted from the finishing device.

* * * * *

UNITED STATES PATENT AND TRADEMARK OFFICE

CERTIFICATE OF CORRECTION

PATENT NO. : 6,860,595 B2
APPLICATION NO. : 10/368221
DATED : March 1, 2005
INVENTOR(S) : Marco A. Guerrero Zepeda It is certified that error appears in the above-identified patent and that said Letters Patent is hereby corrected as shown below:

IN THE CLAIMS

Claim 22, Column 12, line 4, after "configured" insert --to--

Signed and Sealed this

Twenty-sixth Day of June, 2007

JON W. DUDAS
*Director of the United States Patent and Trademark Office*